US009873254B2

(12) United States Patent
Zhao

(10) Patent No.: US 9,873,254 B2
(45) Date of Patent: Jan. 23, 2018

(54) INKJET PRINTING DEVICE AND METHOD

(71) Applicant: BOE TECHNOLOGY GROUP CO., LTD., Beijing (CN)

(72) Inventor: Dejiang Zhao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 15/185,234

(22) Filed: Jun. 17, 2016

(65) Prior Publication Data

US 2017/0050435 A1 Feb. 23, 2017

(30) Foreign Application Priority Data

Aug. 18, 2015 (CN) ..... 2015 1 0509434

(51) Int. Cl.
*B41J 2/16* (2006.01)
*B41J 2/14* (2006.01)

(52) U.S. Cl.
CPC ..... *B41J 2/1606* (2013.01); *B41J 2/1433* (2013.01); *B41J 2002/14411* (2013.01)

(58) Field of Classification Search
None
See application file for complete search history.

(56) References Cited

U.S. PATENT DOCUMENTS

| | | | |
|---|---|---|---|
| 7,335,604 | B2 | 2/2008 | Sakurada |
| 7,459,176 | B2 | 12/2008 | Sakurada |
| 8,962,073 | B2 | 2/2015 | Bulovic |
| 2014/0161968 | A1 | 6/2014 | Kang |

FOREIGN PATENT DOCUMENTS

| | | | |
|---|---|---|---|
| CN | 1439517 | A | 9/2003 |
| CN | 1530227 | A | 9/2004 |
| CN | 101754859 | A | 6/2010 |
| CN | 103862862 | A | 6/2014 |
| JP | 2004-031070 | A | 1/2004 |
| KR | 100915376 | B1 * | 9/2009 |

OTHER PUBLICATIONS

Machine Translation—Khalid, Rahman et al. "Matrix Type Conductive Liquid Ejecting System Using Electrostatic Force", Sep. 3, 2009, Cheju Nat Unive Ind ACAD Coop, [p. 8, Paragraphs 12-15].*
Chinese Office Action in Chinese Application No. 201510509434.9, dated Apr. 6, 2016 with English translation.
Third Chinese Office Action in Chinese Application No. 201510509434.9, dated Jan. 17, 2017 with English translation.

* cited by examiner

*Primary Examiner* — Lisa M Solomon
(74) *Attorney, Agent, or Firm* — Collard & Roe, P.C.

(57) ABSTRACT

An inkjet printing device and method are provided. The inkjet printing device includes a nozzle head; and the nozzle head is provided with a main printing unit and an auxiliary printing unit which share a common liquid supplying pipeline. The main printing unit is located at a middle of the nozzle head and is configured to perform inkjet printing of pixel patterns. The auxiliary printing unit is located at an edge of the nozzle head and is configured to perform inkjet printing of protective patterns. The protective patterns are configured to produce a solvent-protective atmosphere for the pixel patterns at an edge of every printing process.

20 Claims, 2 Drawing Sheets

INKJET PRINTING DEVICE AND METHOD

CROSS REFERENCE TO RELATED APPLICATIONS

Applicant claims priority under 35 U.S.C. §119 of Chinese Application No. 201510509434.9 filed on Aug. 18, 2015, the disclosure of which is incorporated by reference.

TECHNICAL FIELD

Embodiment of present disclosure relate to an inkjet printing device and method.

BACKGROUND

At present, mass-production of Organic Light Emitting Diode (OLED) can only be achieved by utilizing evaporation method. However, since the evaporation method has an extremely low unitization of material, cost of OLED product maintains at a high level, which impacts and restricts development of the OLED product.

SUMMARY

Embodiments of the present disclosure provide an inkjet printing device, including a nozzle head. The nozzle head is provided with a main printing unit and an auxiliary printing unit which share a common liquid supplying pipeline. The main printing unit is located at a middle of the nozzle head and is configured to perform inkjet printing of pixel patterns. The auxiliary printing unit is located at an edge of the nozzle head and is configured to perform inkjet printing of protective patterns, the protective patterns being configured to produce a solvent-protective atmosphere for the pixel patterns at an edge of every printing process.

In an example, the main printing unit includes a plurality of first nozzles located at a middle of the nozzle head, and the first nozzles are disposed at an equal interval. The auxiliary printing unit includes a second nozzle located at an edge of the nozzle head, and a distance from the second nozzle to an outermost first nozzle is smaller than a distance between adjacent first nozzles.

In an example, the distance from the second nozzle to the outermost first nozzle is one half of the distance between adjacent first nozzles.

In an example, number of the second nozzles is an even number which is no smaller than two.

In an example, the inkjet printing device further includes a printing substrate, and the printing substrate is provided with pixel layouts and protective layouts. The pixel layouts are disposed in correspondence to the main printing unit and configured to display the pixel patterns. The protective layouts are disposed in correspondence to the auxiliary printing unit and configured to allow the protective patterns to produce the solvent-protective atmosphere.

In an example, the pixel layouts are distributed on the printing substrate in a matrix, and each of the pixel layouts includes a plurality of elongated-slot structures arranged in columns.

In an example, each of the protective layouts includes a plurality of circular-groove structures arranged in rows, and each of the circular-groove structures is located at a center of adjacent four protective layouts.

In an example, the inkjet printing device further includes an evaporation device configured to dry the printing substrate.

In an example, the inkjet printing device further includes a controlling device configured to independently control the main printing unit and the auxiliary printing unit.

Embodiments of the present disclosure further provide an inkjet printing method, including: aligning a main printing unit to be located above pixel layouts of a printing substrate while aligning an auxiliary printing unit to be located above protective layouts of the printing substrate; connecting both the main printing unit and the auxiliary printing unit to a common liquid supplying pipeline, and independently controlling inkjet printing solutions, respectively; and displaying pixel patterns on the pixel layouts while producing a solvent-protective atmosphere on the protective layouts to allow an uniform film being formed at an edge of every printing process.

BRIEF DESCRIPTION OF THE DRAWINGS

Embodiments of the present disclosure will be described in more detail as below in conjunction with the accompanying drawings to enable those skilled in the art to understand the present disclosure more clearly, in which.

DETAILED DESCRIPTION

Technical solutions and advantages of the embodiments of the present disclosure apparent, the technical solutions of the embodiment will be described in a clearly and fully understandable way in connection with the drawings related to the embodiments of the present disclosure. It is apparent that the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined herein, term "a plurality of" refers to two or more than two. Terms, such as "on," "under," "left," "right," "inside," "outside," "front," "back," "head," "end," or the like are only used to indicate relative position relationship of components with respect to the drawings for convenience of description and simplifying the description of embodiments of the present disclosure, instead of referring to or indicating that the related devices or components must be located in a specific direction or position, or must be configured or operated in a specific direction or position. Therefore such kind of terms cannot be interpreted as a limitation to the present disclosure. Terms, such as "first," "second," "third," or the like are only for description, instead of indicating relative important.

Furthermore, unless otherwise defined herein, terms, such as "mount/mounted," "interconnect/interconnection," "connect/connected," or the like, should be understood generally, for example, it may refer to a connection fixedly, a detachable connection, or an integral connection; it may be a mechanical connection, or an electrical connection/coupling; it may be a direct connection or a connection through a medium. An ordinary skill in the art can understand these terms properly in accordance with actual conditions in embodiments of the present disclosure.

The inventor has realized that, although the inkjet printing technology barely involves material wastage, the material has to be dissolved in a solvent for printing. During printing, the time taken for every printing process is different; as a result, the time spent for the material in every pixel to be dried is different due to solvent volatilization, and a phenomenon of uneven film formation at an interface between two different printing processes will be occurred.

First Embodiment

Figure 1:
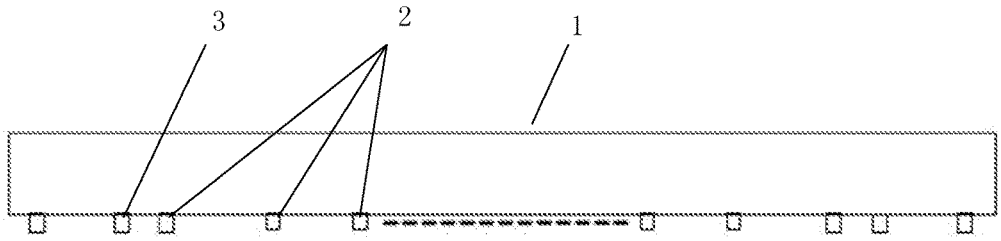
FIG. 1 is a schematically structural diagram illustrating a nozzle head of an embodiment of the present disclosure.
Figure 3:
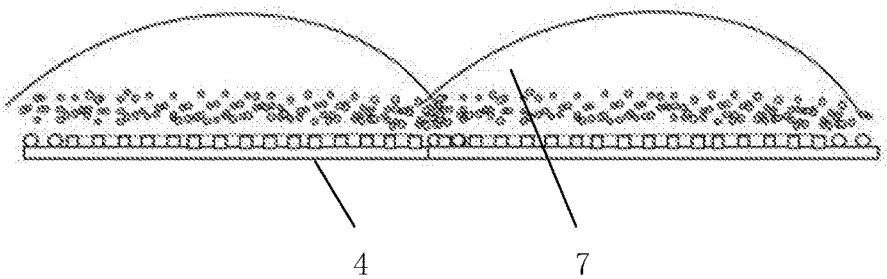
FIG. 3 is a schematic diagram illustrating forming a solvent-protective atmosphere on the printing substrate of an embodiment of the present disclosure.

As illustrated in FIG. 1, an inkjet printing device as provided by a first embodiment includes a nozzle head 1 configured to perform inkjet printing. The nozzle head 1 is provided with a main printing unit and an auxiliary printing unit. The main printing unit and the auxiliary printing unit which share a common liquid supplying pipeline. The main printing unit is located at a middle of the nozzle head 1 and is configured to perform inkjet printing of pixel patterns. The auxiliary printing unit is located at an edge of the nozzle head 1 and is configured to perform inkjet printing of protective patterns. The protective patterns are configured to produce a solvent-protective atmosphere for the pixel patterns at an edge of every printing process, so as to form a solvent-protective atmosphere 7 at an interface between two printing processes, as illustrated in FIG. 3, thereby achieving an objective of eliminating a bad printing at a joint of printing processes.

For example, the main printing unit includes a plurality of first nozzles 2 located at a middle of the spray 1, and the first nozzles 2 are arranged at an equal interval and configured to print the pixel patterns, for example, OLED patterns. The auxiliary printing unit includes a second nozzle 3 located at an edge of the nozzle head 1; in other words, the second nozzle 3 is located at two sides of the main printing unit including the plurality of first nozzles 2. The first nozzles 2 and the second nozzles 3 are connected to a common liquid supplying pipeline.

A distance from each of the second nozzles 3 to an outermost first nozzle 2 is smaller than a distance between adjacent first nozzles 2. For example, the distance from each of the second nozzles 3 to the outermost first nozzle 2 is one half of the distance between adjacent first nozzles 2; such design of location can produce a better solvent-protective atmosphere.

An interval between nozzles in the nozzle head 1 can be classified in two ways, one is that the nozzles are located at two sides of the nozzle head 1, the other is that the nozzles are located at a middle of the nozzle head 1. The nozzle head 1 can have a shape of, for example, elongated strip. For example, the number of the second nozzles 3 can be an even number which is no smaller than two, but the embodiments of the present disclosure are not limited thereto. The interval between nozzles is not limited to any particular forms, for example, two second nozzles 3 can be disposed at an edge location of every side of the nozzle head, and a distance from a second nozzle 3 located at an inner side to the outermost first nozzle 2 is one half of a distance between adjacent first nozzles 2, and the other adjacent nozzles (either at a middle location or an edge location) have equal intervals.

Second Embodiment

Figure 2:
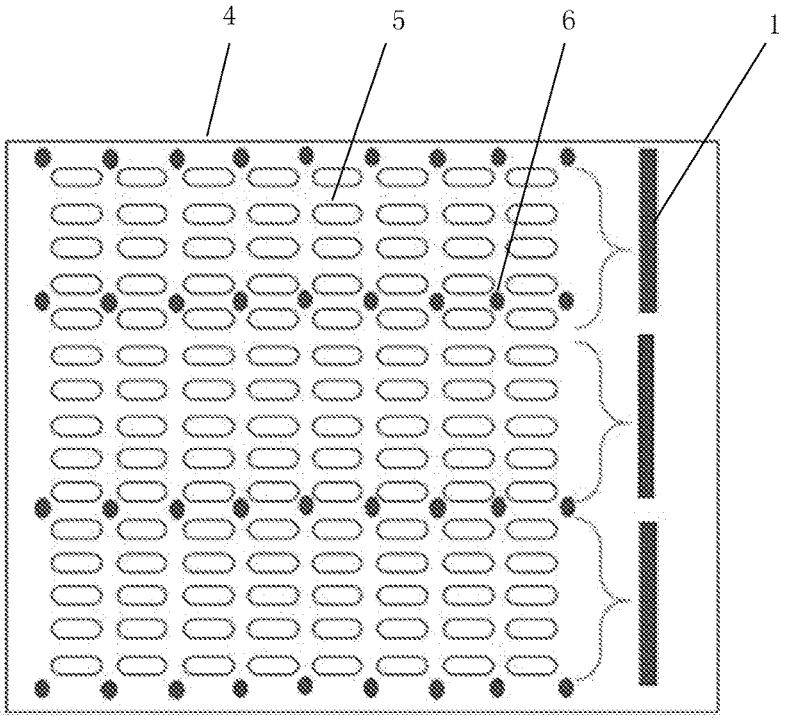
FIG. 2 is a schematically structural diagram illustrating a printing substrate of an embodiment of the present disclosure.

As illustrated in FIG. 2, technical contents shared between the second embodiment and the first embodiment are not repeatedly described herein, and the contents disclosed in the first embodiment should be considered to be also disclosed by the second embodiment. As compared with the first embodiment, the inkjet printing device of the second embodiment further includes a printing substrate 4. The printing substrate 4 can be utilized in cooperation with the nozzle head 1 to achieve better effect of eliminating bad printing.

For example, the printing substrate 4 is provided with pixel layouts and protective layouts. The pixel layouts are disposed in correspondence with the main printing unit and configured to display the pixel patterns; the protective layouts are disposed in correspondence with the auxiliary printing unit and configured to allow the protective patterns to form a solvent-protective atmosphere 7.

For example, each of the protective layouts includes a plurality of circular-groove structures 6 arranged in rows, and each of the circular-groove structures 6 can be located at a center of adjacent four protective layouts; in other words, the circular-groove structures 6 are disposed with intervals at an interface between two printing processes. According to actual conditions of layouts, a parallel distance between two pixels is relatively small, but areas at top and bottom of a pixel where a TFT is located are relatively large and sufficient to receive the protective patterns (auxiliary patterns). In addition, the auxiliary patterns are disposed to produce an atmosphere, as a result, if auxiliary patterns are disposed too close to the main pixels, the drying of the pixels would be impacted.

Correspondingly, the pixel layouts are distributed on the printing substrate 4 in a matrix, and each of the pixel layouts includes a plurality of elongated-slot structures 5 arranged in columns. In other words, the pixel layouts are uniformly distributed to be arranged laterally in rows and longitudinally in columns. Each group includes five elongated-slot structures 5. Such a design of the elongated-slot structure 5 and the circular-groove structure 6 facilitates uniformity of film formation.

Third Embodiment

Technical contents shared between the third embodiment and the first, second embodiments are not repeatedly described herein. Based on the foregoing embodiments, the third embodiment can make further modifications and variations.

For example, the inkjet printing device further includes an evaporation device configured to evaporate the pixel layouts and protect the solvent in the protective layouts. In addition, the inkjet printing device further includes a controlling device configured to independently control the main printing unit and the auxiliary printing unit so as to achieve independent control of amount of ink droplets for printing. The inkjet printing device further includes a solution chamber connected to the main printing unit and the auxiliary printing unit through a liquid supplying pipeline. In order to prevent being contaminated by the evaporation solvent, a solvent collecting device may be provided. The solvent collecting device can be located above the printing substrate 4.

Fourth Embodiment

Figure 4:
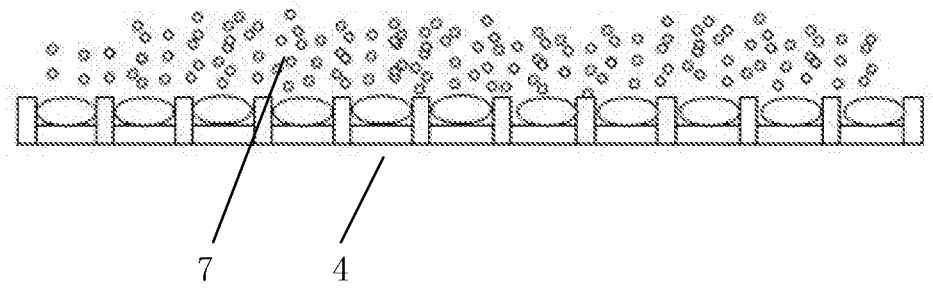
FIG. 4 is a side view illustrating solvent volatilization upon performing inkjet printing on the printing substrate in an embodiment of the present disclosure.
Figure 5:
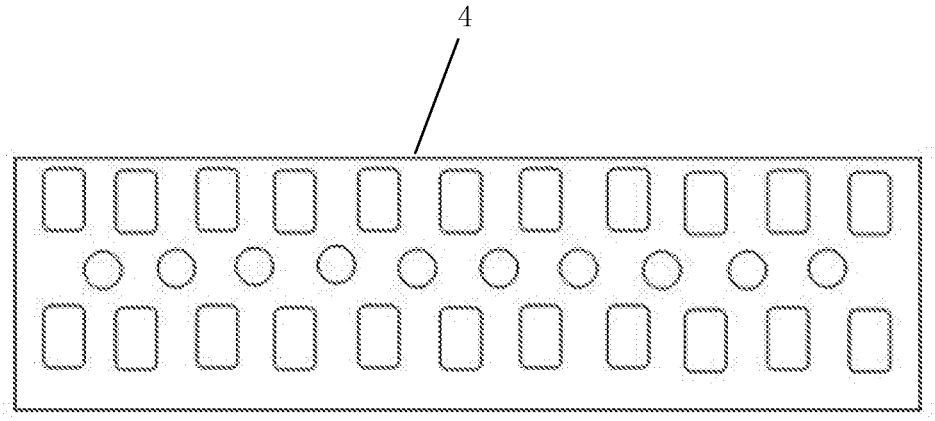
FIG. 5 is a top view illustrating solvent volatilization upon performing inkjet printing on the printing substrate in an embodiment of the present disclosure.

As illustrated in conjunction with FIGS. 3-5, the present embodiment also provides an inkjet printing method which is performed according to any inkjet printing device in the foregoing embodiments. The method includes steps as below.

S1, aligning the main printing unit to be located above the pixel layouts of the printing substrate while aligning the auxiliary printing unit to be located above the protective layouts of the printing substrate. In other words, the main printing unit and the auxiliary printing unit can be moved together with the nozzle head, to be located above the printing substrate so as to perform inkjet printing.

For example, actions of the above components can be achieved by the controlling device so as to achieve intelligent automatic control in combination with a computer system.

S2, connecting both the main printing unit and the auxiliary printing unit to a common liquid supplying pipeline, and independently controlling inkjet printing solutions separately; also, independently controlling an amount of ink droplets for printing by the controlling device.

S3, displaying the pixel patterns on the pixel layouts while producing a solvent-protective atmosphere on the protective layouts to allow film formation at an edge of every printing process being uniform. For example, as illustrated in FIG. 3, in an overlapped area of two printing processes, as a result of the arrangement of auxiliary patterns, the solvent-protective atmosphere produced by the auxiliary patterns allows the edge of every printing process to be protected by a solvent atmosphere so that uneven film thickness is avoided. Afterwards, during drying, as illustrated in FIG. 5, each of the pixel layouts displayed as normal is injected with ink at a same amount. As illustrated in FIG. 4, although an edge area of printing process still remains, it's equivalent to extend the overlapped area of printing process in a different manner with the aid of the auxiliary unit, which enables effective protection of internal pixel region.

Embodiments of the present disclosure provide an inkjet printing device which effectively eliminates phenomenon of uneven film formation occurred at an interface of two printing processes by printing the pixel patterns through the main printing unit while printing the protective patterns through the auxiliary printing unit to produce the solvent-protective atmosphere for the pixel patterns at an edge of every printing process. The inkjet printing device is not complex in structure, convenient in operation and easy for promotion and application.

The described above are only illustrative implementations of the present disclosure, and the present disclosure is not intended to limited thereto. For a person of ordinary skill in the art, various modifications and improvements can be made without departing from the principle and spirit of the present disclosure, and all of which shall fall within the scope of the present disclosure.

The present application claims the benefits of priority of Chinese patent application No. 201510509434.9 filed on Aug. 18, 2015 and entitled "AN INKJET PRINTING DEVICE AND METHOD," which is incorporated herein by reference entirely.

What is claimed is:

1. An inkjet printing device, comprising: a nozzle head, the nozzle head being provided with a main printing unit and an auxiliary printing unit which share a common liquid supplying pipeline, the main printing unit being located at a middle of the nozzle head and being configured to perform inkjet printing of pixel patterns, the auxiliary printing unit being located at an edge of the nozzle head and being configured to perform inkjet printing of protective patterns, and the protective patterns being configured to produce a solvent-protective atmosphere for the pixel patterns at an edge of every printing process, wherein the main printing unit comprises a plurality of first nozzles located at a middle of the nozzle head, the plurality of first nozzles being disposed at an equal interval; and the auxiliary printing unit comprises a second nozzle located at an edge of the nozzle head, a distance from the second nozzle to an outermost first nozzle being smaller than a distance between adjacent first nozzles.

2. The inkjet printing device according to claim 1, wherein the distance from the second nozzle to the outermost first nozzle is one half of the distance between adjacent first nozzles.

3. The inkjet printing device according to claim 1, wherein a number of the second nozzles is an even number which is no smaller than two.

4. The inkjet printing device according to claim 1, further comprising a printing substrate, the printing substrate being provided with pixel layouts and protective layouts, the pixel layouts being disposed in correspondence to the main printing unit and configured to display the pixel patterns, the protective layouts being disposed in correspondence to the auxiliary printing unit and configured to allow the protective patterns to form the solvent-protective atmosphere.

5. The inkjet printing device according to claim 4, wherein the pixel layouts are distributed on the printing substrate in a matrix, and each of the pixel layouts includes a plurality of elongated-slot structures arranged in columns.

6. The inkjet printing device according to claim 4, wherein each of the protective layouts includes a plurality of circular-groove structures arranged in rows, and each of the circular-groove structures is located at a center of adjacent four protective layouts.

7. The inkjet printing device according to claim 1, further comprising an evaporation device configured to dry the printing substrate.

8. An inkjet printing device, comprising: a nozzle head, the nozzle head being provided with a main printing unit and an auxiliary printing unit which share a common liquid supplying pipeline, the main printing unit being located at a middle of the nozzle head and being configured to perform inkjet printing of pixel patterns, the auxiliary printing unit being located at an edge of the nozzle head and being configured to perform inkjet printing of protective patterns, and the protective patterns being configured to produce a solvent-protective atmosphere for the pixel patterns at an edge of every printing process; and a controlling device configured to independently control the main printing unit and the auxiliary printing unit.

9. The inkjet printing device according to claim 2, wherein a number of the second nozzles is an even number which is no smaller than two.

10. The inkjet printing device according to claim 3, further comprising a printing substrate, the printing substrate being provided with pixel layouts and protective layouts, the pixel layouts being disposed in correspondence to the main printing unit and configured to display the pixel patterns, the protective layouts being disposed in correspondence to the auxiliary printing unit and configured to allow the protective patterns to form the solvent-protective atmosphere.

11. The inkjet printing device according to claim 10, wherein each of the protective layouts includes a plurality of circular-groove structures arranged in rows, and each of the circular-groove structures is located at a center of adjacent four protective layouts.

12. The inkjet printing device according to claim 1, further comprising a printing substrate, the printing substrate being provided with pixel layouts and protective layouts, the pixel layouts being disposed in correspondence to the main printing unit and configured to display the pixel patterns, the protective layouts being disposed in correspondence to the auxiliary printing unit and configured to allow the protective patterns to form the solvent-protective atmosphere.

13. The inkjet printing device according to claim 2, further comprising a printing substrate, the printing substrate being provided with pixel layouts and protective layouts, the pixel layouts being disposed in correspondence to the main printing unit and configured to display the pixel patterns, the protective layouts being disposed in correspondence to the auxiliary printing unit and configured to allow the protective patterns to form the solvent-protective atmosphere.

14. The inkjet printing device according to claim 9, further comprising a printing substrate, the printing substrate being provided with pixel layouts and protective layouts, the pixel layouts being disposed in correspondence to the main printing unit and configured to display the pixel patterns, the protective layouts being disposed in correspondence to the auxiliary printing unit and configured to allow the protective patterns to form the solvent-protective atmosphere.

15. The inkjet printing device according to claim 1, further comprising an evaporation device configured to dry the printing substrate.

16. The inkjet printing device according to claim 1, further comprising a controlling device configured to independently control the main printing unit and the auxiliary printing unit.

17. The inkjet printing device according to claim 7, further comprising a controlling device configured to independently control the main printing unit and the auxiliary printing unit.

18. The inkjet printing device according to claim 11, wherein the pixel layouts are distributed on the printing substrate in a matrix, and each of the pixel layouts includes a plurality of elongated-slot structures arranged in columns.

19. An inkjet printing method, comprising:

aligning a main printing unit to be located above pixel layouts of a printing substrate while aligning an auxiliary printing unit to be located above protective layouts of the printing substrate;

connecting both the main printing unit and the auxiliary printing unit to a common liquid supplying pipeline, and independently controlling inkjet printing solutions, respectively; and displaying pixel patterns on the pixel layouts while producing a solvent-protective atmosphere on the protective layouts to allow a uniform film being formed at an edge of every printing process.

20. The inkjet printing device according to claim 8, wherein the main printing unit comprises a plurality of first nozzles located at a middle of the nozzle head, the plurality of first nozzles being disposed at an equal interval; and the auxiliary printing unit comprises a second nozzle located at an edge of the nozzle head, a distance from the second nozzle to an outermost first nozzle being smaller than a distance between adjacent first nozzles.

* * * * *